US008216412B2

(12) United States Patent
Gambini

(10) Patent No.: US 8,216,412 B2
(45) **Date of Patent: *Jul. 10, 2012**

(54) GLUING MACHINE AND METHOD FOR THE GLUING OF THE FINAL EDGE OF A LOG

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 226 days.

This patent is subject to a terminal disclaimer.

(21) Appl. No.: 12/644,307

(22) Filed: Dec. 22, 2009

(65) Prior Publication Data

US 2010/0154976 A1 Jun. 24, 2010

(30) Foreign Application Priority Data

Dec. 24, 2008 (IT) ..... MI2008A2320

(51) Int. Cl.
*B65H 81/00* (2006.01)

(52) U.S. Cl. ..... 156/184; 156/446; 156/448; 156/450; 156/456; 156/459; 118/243

(58) Field of Classification Search ..... 156/184, 156/187, 191, 193, 446, 448, 499, 450, 456–458; 118/243

See application file for complete search history.

(56) References Cited

U.S. PATENT DOCUMENTS

| | | | | |
|---|---|---|---|---|
| 5,681,421 | A | 10/1997 | Biagiotti | |
| 5,759,326 | A | 6/1998 | Vigneau | |
| 5,800,652 | A * | 9/1998 | Vigneau et al. | 156/184 |
| 2005/0284557 | A1 * | 12/2005 | Gambini | 156/64 |

FOREIGN PATENT DOCUMENTS

| | | |
|---|---|---|
| EP | 1 440 925 | 7/2004 |
| EP | 1 609 534 | 12/2005 |

* cited by examiner

*Primary Examiner* — Sing P Chan
(74) *Attorney, Agent, or Firm* — Lucas & Mercanti, LLP

(57) ABSTRACT

A gluing machine for gluing the final edge of a log successively comprising an introduction group of the logs one after the other into the machine, an unwinding group of the log associated with identification means of the final edge, an opening group of the final edge from the log, a glue transfer group onto the log and a rewinding group of the final edge onto the log, in which the unwinding group of the log comprises a pair of rollers arranged one on top of the other to make a passage for the log, the pair of rollers being selectively for the feeding and for the retention in rotation of the log, at least one inclined surface of free rolling of the log being provided downstream of the pair of rollers.

13 Claims, 6 Drawing Sheets

GLUING MACHINE AND METHOD FOR THE GLUING OF THE FINAL EDGE OF A LOG

CROSS-REFERENCE TO RELATED APPLICATION

This application claims the benefit of priority from Italian Patent Application No. MI2008A002320, filed Dec. 24, 2008, the contents of which are incorporated herein by reference.

BACKGROUND OF INVENTION

The present invention refers to a gluing machine and method for the gluing a final edge of a log.

Machines for gluing the edge of logs fed one after the other are currently known.

Such machines commonly successively comprise, following the direction of forward movement of the logs, an unwinding station for the logs to identify the final edge, a station in which the final edge is held, a station in which the log receives glue at an inner layer of paper with respect to that defined by the final edge, and a final rewinding station of the final edge onto the log in which, thanks to the glue transferred in the previous station, the edge is glued to the rest of the log.

An example of such a type of machine is described, for example, in patent EP541496. In EP541496 the forward movement of the log in the work station listed above is carried out by means of at least an upper belt that starts from the unwinding station of the logs and reaches at least the station in which the final edge is held if not, alternatively, the last rewinding station of the final edge onto the log.

In particular, in the prior art such an upper belt cooperates both with the forward movement of the log between the various stations as well as with some members of the stations themselves for the processing of the log while it rolls upon itself.

For example, the aforementioned upper belt cooperates at the bottom with inclined surfaces, as described in EP1609334, that can include belts or bands, as disclosed in EP541496 to make the logs move forward between the stations, but also with rollers or belts as mentioned in EP1440925 at the stations themselves.

Such known machines, although they do indeed allow the final edges to be glued on the relative logs, have some drawbacks linked to the speed of production of the finished logs that, due to what is described above, is closely linked to the forward movement speed of the aforementioned upper belt.

Such a limit derives from the fact that in known machines there are constructive elements that, cooperating both with the processing in some stations and with the forward movement of the logs between the work stations themselves, make the rolling speed of the log to be glued not able to be freely modified as desired from one station to the other.

In other words, in known machines the rolling speed of the log, with or without forward movement in a given station or in a section upstream or downstream of it, is unfortunately limited to a lower rolling speed required in another station in order to have a correct final gluing.

In particular, such a drawback is even more pronounced in the passage between the unwinding station in which the final edges of the logs are also identified, that is currently defined just by a lower roller and by the aforementioned upper belt, and the next station at which the log arrives again through the upper belt.

Indeed, it is known that in order to correctly identify the final edge, a step that has a direct influence upon the quality of the finished log, it is necessary to make the log rotate without feeding the log at a low speed. Conversely, once the final edge has been identified, it would be desirable to feed the log towards the next station as quickly as possible. However, since both the unwinding station and identification station of the final edge and the section for moving forward to the next station cooperate with the upper belt, the feeding speed of the log downstream of the unwinding is limited to the low rotation speed that allows correct identification of the final edge during the unwinding itself.

Consequently, in the section for feeding between the unwinding station and identification station of the final edge and the next station, the log, which could move forward at any speed without jeopardising the processing quality, moves forward at a very low speed limited by that of the upper belt that is indeed kept low to allow correct identification of the final edge during unwinding.

SUMMARY OF INVENTION

The purpose of the present invention is to make a gluing machine and method for the gluing of the final edge of a log capable of solving the aforementioned drawbacks of the prior art in an extremely simple, cost-effective and particularly functional manner.

Another purpose is to make a gluing machine and method for the gluing of the final edge of a log that allows a finished log to be made very quickly.

Yet another purpose is to be able to have a gluing machine and method for the gluing of the final edge of a log in which the feeding speeds of the log between the various work stations and the rolling speeds without feeding of the log in the stations themselves are mutually independent and able to be adjusted differently.

Yet another purpose is to be able to have a gluing machine and method for the gluing of the final edge of a log in which there are no common elements between the unwinding station and the next feeding section of the log to the next work station.

These purposes, according to the present invention are accomplished by making a gluing machine and method for the gluing of the final edge of a log as outlined in the independent claims.

Further characteristics of the invention are outlined by the dependent claims.

BRIEF DESCRIPTION OF THE DRAWINGS

The characteristics and advantages of a gluing machine and method for the gluing of the final edge of a log according to the present invention shall become clearer from the following description, given as an example and not for limiting purposes, referring to the attached schematic drawings, in which.

DETAILED DESCRIPTION OF THE DRAWINGS

Figure 1:
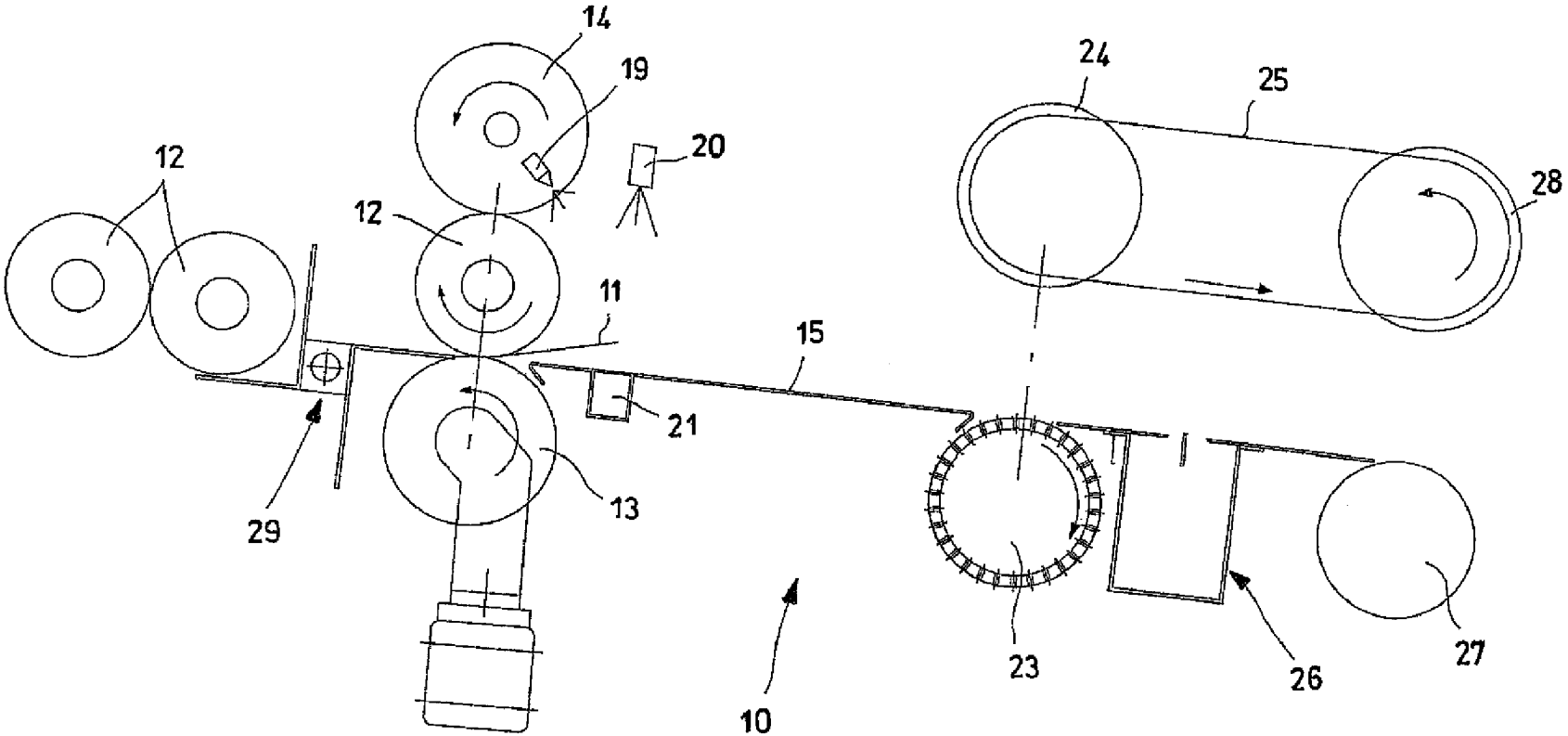
FIGS. 1-5 are side elevation partial section views of an embodiment of the gluing machine for the gluing of the final edge of a log according to the present invention in different and successive operative positions.

With reference to the figures, a gluing machine for the gluing of the final edge of a log according to the present invention is shown with 10.

The machine 10, which can be seen in all of the figures, comprises, successively from upstream to downstream, following the feeding of the log 12 that enters the machine 10 with a free final edge 11 and exits with the same edge 11 glued, an introduction apparatus 29 that receives the logs 12 one after the other, an unwinding apparatus, an opening apparatus which opens the final edge 11 from the relative log 12, a glue transfer apparatus 26 which transfers glue onto the logs 12 and a rewinding apparatus which rewinds the final edge 11 onto the log 12.

In an example embodiment, the introduction apparatus 29 can comprise a rotary selector 29, which is shaped like a star, that is equipped with a series of receiving elements that receive the individual logs and feed them one after the other towards the unwinding apparatus.

For the sake of clarity, by the term log 12 is referred to an assembly defined by an inner winding core and paper wound around the core that ends, with a free edge 11.

In particular, according to the present invention the unwinding apparatus of the machine 10 comprises a pair of rollers 13, 14, upper and lower unwinding roller 14, 13, respectively. The rollers are arranged one roller 14 on top of the other roller 13 to make a passage for the logs 12, which can also be defined by calendering, downstream of the introduction apparatus 29.

Such rollers 13, 14 are motorised independently to alternatively impose a rolling without feeding upon the log 12 as well as the forward movement of the log 12 beyond the rollers 13, 14.

In particular, the pair of rollers 13, 14, while imposing a rolling without feeding upon the log 12, cooperate with a blowing element 19, associated with the upper unwinding roller 14, which unwinds the final edge 11 from the log 12 and lays it out on a first portion of an inclined surface 15 above which a detection photocell 20 of the final edge 11 itself is arranged.

In particular, the aforementioned inclined surface 15 is for free rolling of the log 12 downstream of the pair of rollers 13, 14.

In order to carry out the thrusting step of the log 12 beyond the pair of rollers 13, 14 it is foreseen that, in coordination with the photocell 20, one of the unwinding rollers is stopped while the other unwinding roller 14, which continues to rotate, consequently takes the log 12 away.

In order to ensure correct reading of the final edge 11 laid on the inclined surface 15, in the first portion of the inclined surface 15 itself downstream of the lower unwinding roller 13, a suction box 21 is provided that is suitable for keeping the final edge 11 correctly laid out without creases.

Such an unwinding step of the log 12 is shown in FIG. 1 in which both of the rollers 13, 14 are set in rotation, in particular, in the same direction and at the same speed, to make the log 12 roll without feeding and to allow the blowing element 19 to lay out the edge 11 on the first section of the inclined surface 15.

As can be seen in all of the figures, according to the invention the inclined surface 15 during the feeding of the log 12 downstream of the rollers 13, 14 does not cooperate with any element of the unwinding apparatus.

Consequently, the feeding speed of the log 12 on the inclined surface 15 is not, advantageously, limited by the rotation speed imposed upon the log 12 by the rollers 13, 14 during the unwinding of the edge 11.

According to a first embodiment, shown in FIGS. 1-5, the machine 10 comprises a single inclined surface 15 of free rolling of the log 12 that starts downstream of the pair of rollers 13, 14 and ends upstream of the opening apparatus of the final edge 11.

Figure 6:
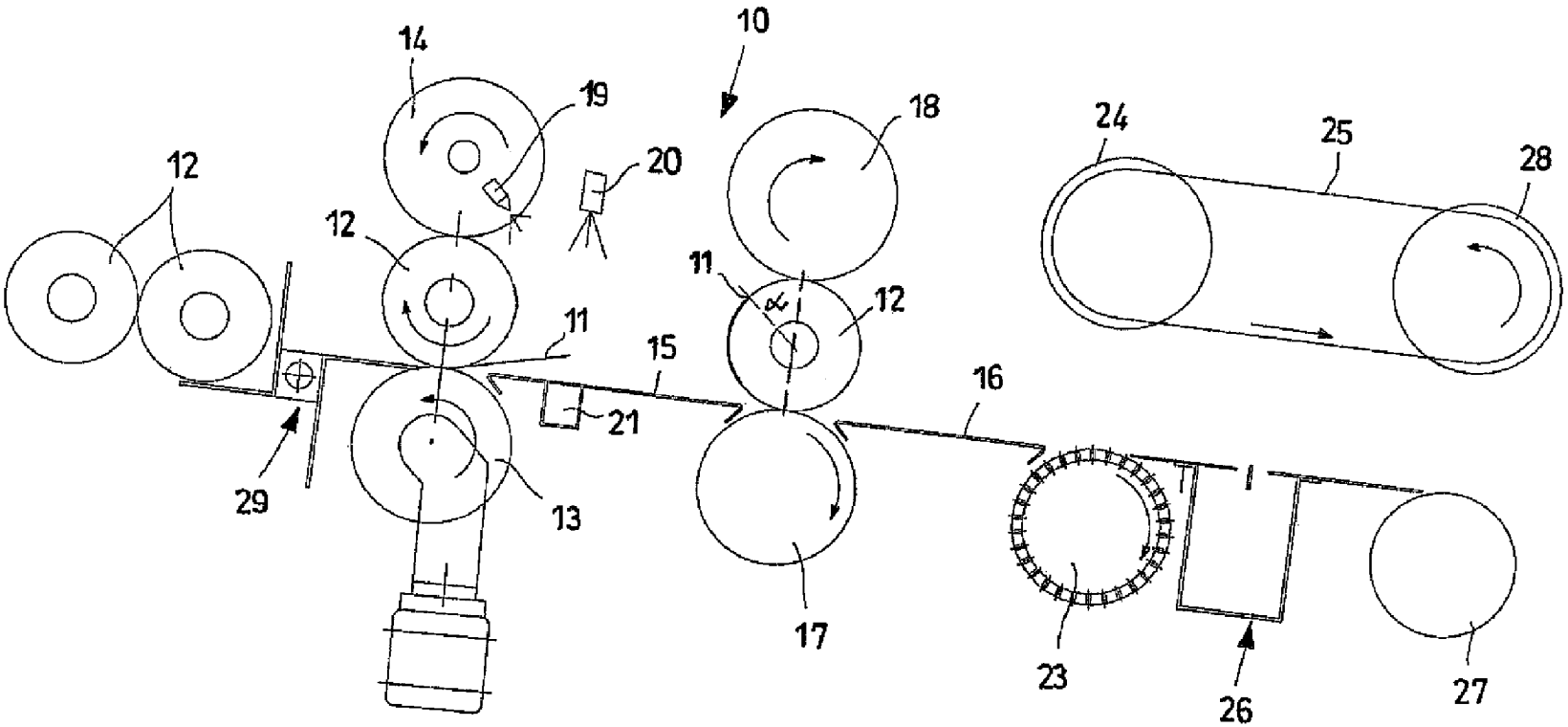
FIG. 6 is a side elevation partial section view of another embodiment of the gluing machine for the gluing of the final edge of a log according to the present invention.

Alternatively, in a second embodiment shown in FIG. 6, the machine 10 can also comprise an independent timing apparatus for the log 12, which is suitable for arranging the edge 11 at a certain point of the machine 10, and winding the edge 11 on the relative log 12 in a certain angular position $\alpha$ where the log 12 is arranged between the pair of unwinding rollers 13, 14 and the opening apparatus of the final edge 11.

Such timing, i.e. as stated the arrangement of the edge 11 at a certain point of the machine 10, wound on the relative log 12 with a certain angular position $\alpha$, will be justified later on in the description when the opening apparatus of the edge 11 will be described.

According to such an embodiment shown in FIG. 6, the machine 10 comprises a first inclined surface 15 that starts downstream of the pair of unwinding rollers 13, 14 and ends upstream of the timing apparatus, and a second inclined surface that starts downstream of the timing apparatus and ends upstream of the opening apparatus of the final edge 11.

The two inclined surfaces 15 and 16 can also be a single surface that is interrupted at the timing apparatus of the log 12.

According to the embodiment of FIG. 6, such a timing apparatus comprises a pair of timing rollers 17, 18, a lower timing roller 17 and an upper timing roller 18, respectively, arranged one timing roller 18 on top of the other timing roller 17 to make a passage, of the calendered type, for the log 12.

Like the pair of unwinding rollers 13, 14, the pair of timing rollers 17, 18 are also independently motorised and can be actuated to selectively roll the log 12 without feeding the log 12, as well as, feed the log 12 beyond the timing rollers 17, 18 on the inclined surface 16.

In order to carry out a thrusting step of the log 12 beyond the timing rollers 17, 18, it is foreseen that, in coordination with further identification means (not shown) of the edge 11, one of the two timing rollers 18 is stopped and the other timing roller 17, which continues to rotate, consequently takes the log 12 away.

Alternatively, instead of the pair of timing rollers 17, 18, it is possible to foresee other components, such as a pair of timing belts and/or other elements suitable for carrying out the timing as described previously.

Downstream of the inclined surface 15, according to the embodiment shown in FIGS. 1-5, or downstream of the inclined surface 16 in the embodiment shown in FIG. 6, the machine 10 comprises an opening apparatus of the final edge 11 to hold the edge 11 in a particular position so that the log 12 can receive the glue at a more inner layer of paper with respect to the one defined by the edge 11 itself.

Preferably, such an opening apparatus of the final edge 11 comprises two rollers 23, 24 arranged one roller 24 on top of the other roller 23 to make a passage, of the calendered type, for the log 12 in which at least one roller 23 of the two rollers 23, 24 is of the suction type.

Such rollers 23, 24, like for the unwinding rollers 13, 14, are independently motorised and can be selectively actuated to impose rolling without feeding on the log 12, as well as, a feeding of the log 12 towards the glue transfer apparatus 26 arranged downstream of the lower roller 23.

Figure 2:
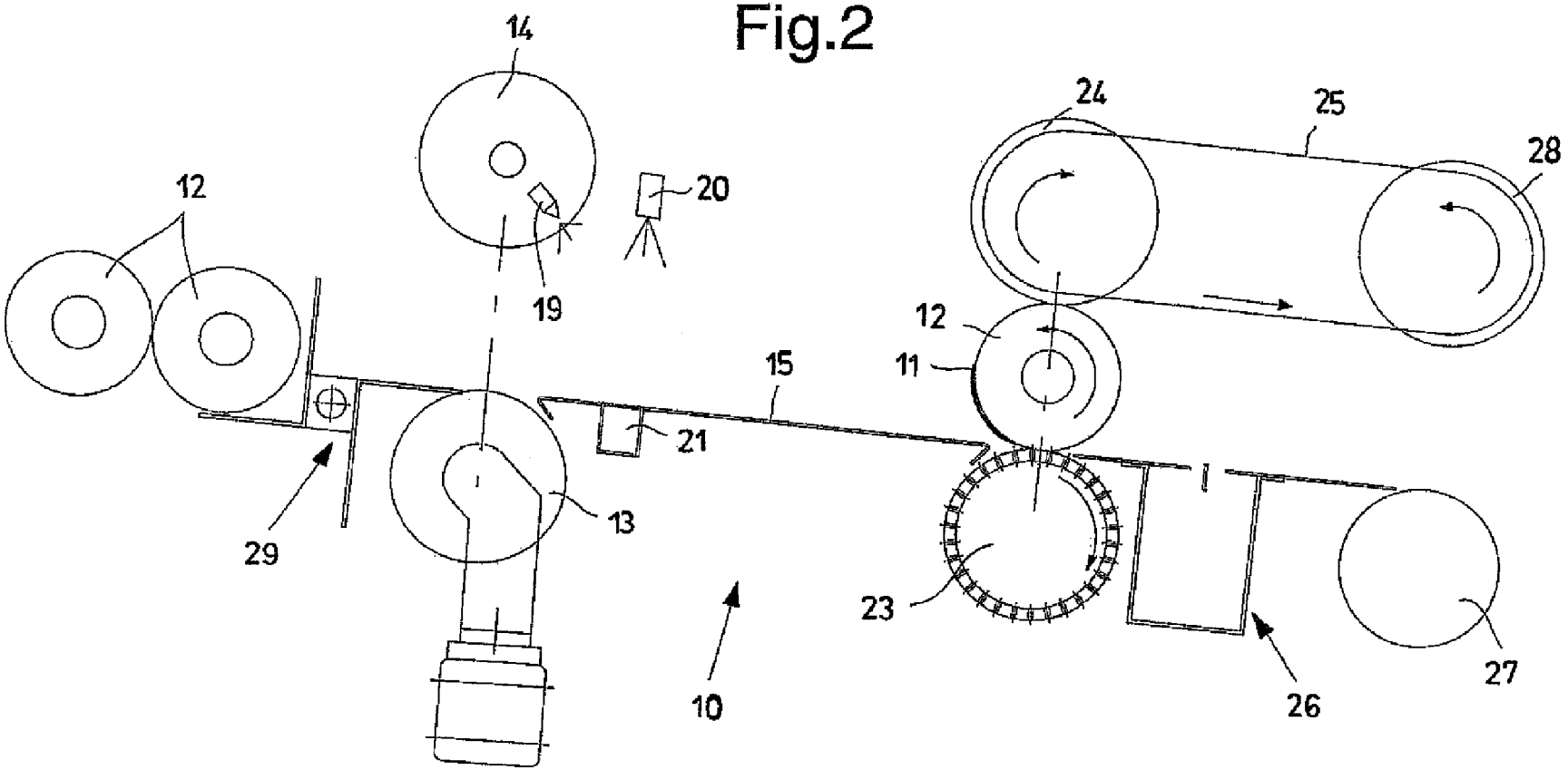

The step in which both of the rollers 23, 24 are set in rotation and impose upon the log 12 a rolling without feeding is shown in FIG. 2.

During such a step the suction of the roller 23 is active so as to hold, and consequently at least partially wind the edge 11 on the sucked roller 23.

The presence of the timing apparatus shown in FIG. 6 makes the machine 10 even quicker in the opening step of the edge 11 by ensuring that the log 12 first makes contact with the suction roller 23 precisely with the edge 11.

In this way, it is possible to immediately begin the opening step of the edge 11 from the relative log 12.

In order to ensure such first contact, the timing a of the edge 11 is necessarily set taking into account the diameter of the log 12 and the length of the inclined surface 16.

In other words the means, not shown, for identifying the edge 11 on the log 12 rotating without feeding between the timing rollers 17, 18 will impose the blocking, for example, of the roller 18 once the angle $\alpha$ is defined between the edge 11 and the vertical in function of the diameter of the log 12 and of the length of the second inclined surface 16 so that the first contact of the log 12 with the suction roller 23 takes place precisely at the edge 11.

In the embodiments of FIGS. 1-5, where the timing rollers 17, 18 are not present, the timing path of the log 12, again in order to make the first contact with the suction roller 23, takes place precisely at the edge 11 and the log 12, is unwound by the unwinding rollers 13, 14 by imposing a rotation without feeding upon the log 12 after the edge 11 laid out on the surface 15 is identified.

Also, when the log 12 rotates between the rollers 13, 14, the angle $\alpha$ will be defined between the edge 11 and the vertical in function of the diameter of the log 12 and the length of the inclined surface 15 so that the first contact of the log 12 with the suction roller 23 takes place precisely at the edge 11.

Of course, the embodiment of FIG. 6, with different independent apparatuses for the unwinding and the timing of the log 12, offers a greater production speed of finished logs disengaging firstly the rollers 13, 14, not indeed intended also for timing, and allowing a faster introduction into the machine 10 of a new log 12.

Once the edge 11 reaches a certain winding on the suction roller 23, the roller 24, in cooperation with further means (not shown) for identifying the edge 11 wound on the suction roller 23, is stopped.

Figure 3:
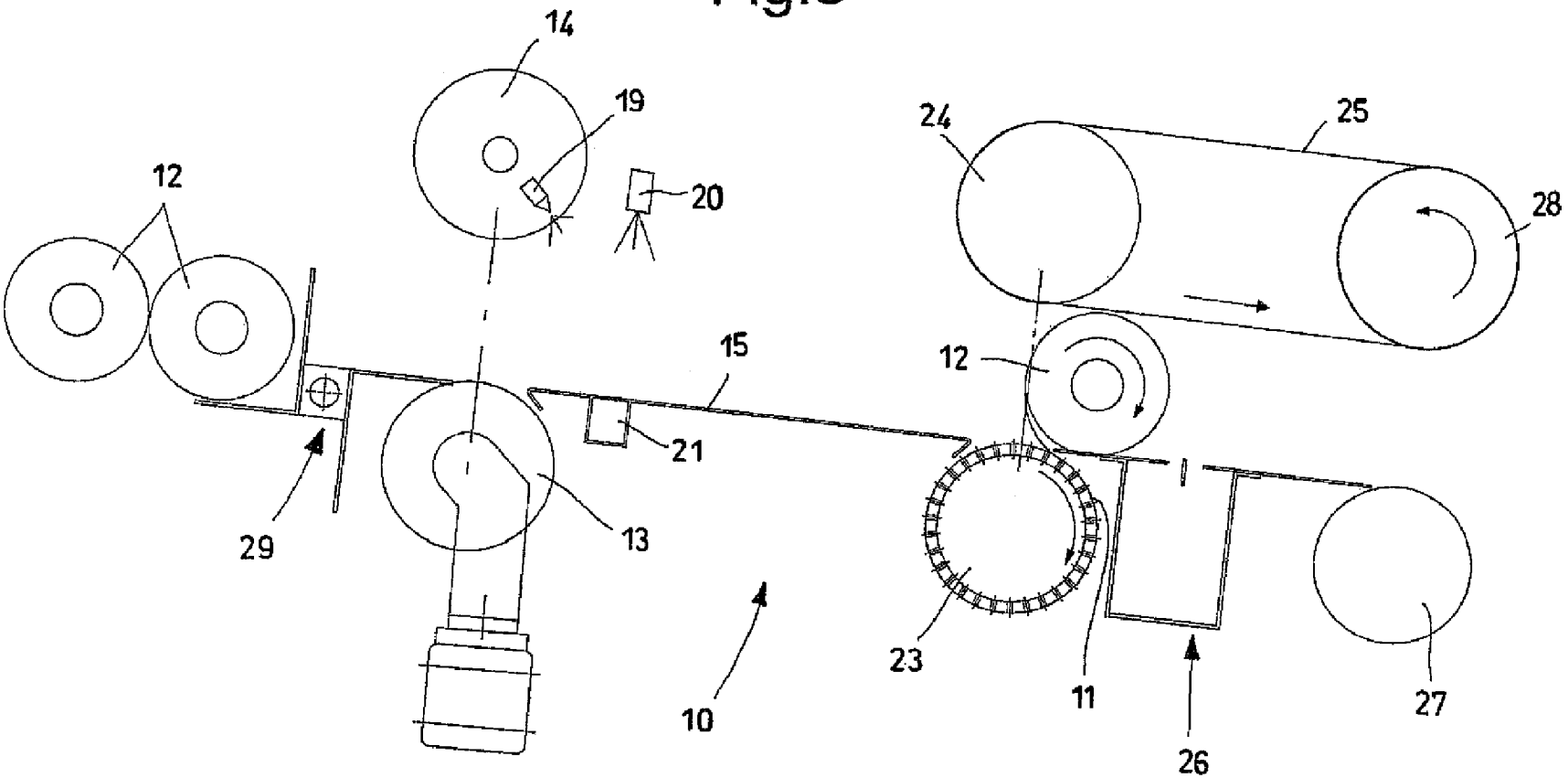

In this condition, shown in FIG. 3, the log 12 moves forward beyond the pair of rollers 23, 24 while the edge remains associated with the suction roller 23.

Figure 4:
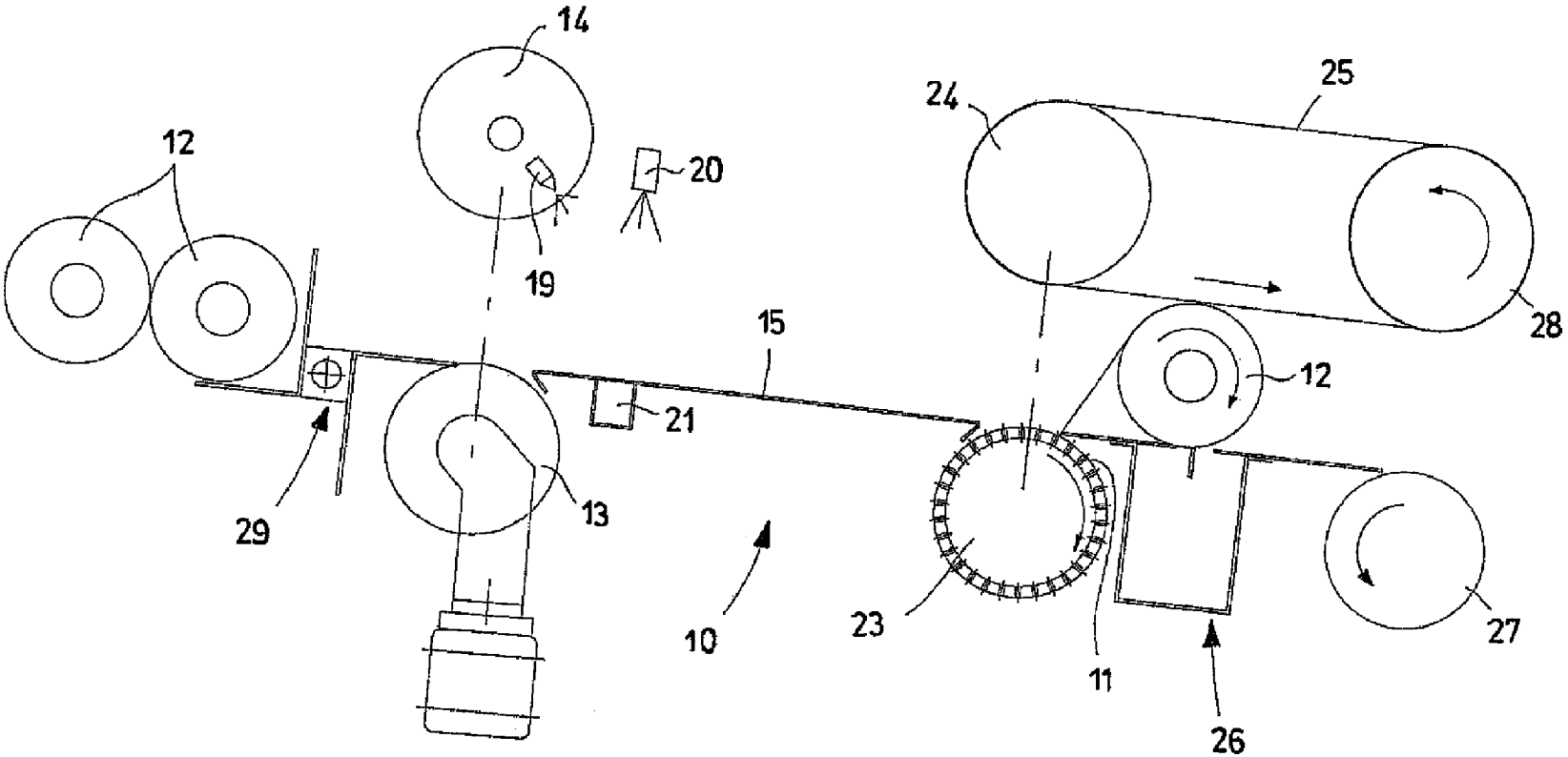

Since downstream of the suction roller 23 the machine 10 comprises a glue transfer apparatus 26 such glue, as can be seen in FIG. 4, is transferred onto the log 12 at an inner layer of paper with respect to that defined by the edge 11 wound on the log 12.

The forward passage of the log 12 in the way described above for the glue transfer apparatus 26 is ensured by an upper belt that starts at least downstream of the roller 24 and ends downstream of the glue transfer apparatus 26.

In the example shown, the glue transfer apparatus 26 is schematised with a recipient containing glue and an element that projects at the top capable of transferring glue onto a lower portion of the log 12 that transits over it by means of the upper belt 25.

Alternatively, the glue transfer apparatus 26 can be of any known type.

After the transfer of glue, the suction of the roller 23 is interrupted and the log 12, thanks to the aforementioned upper belt 25, reaches the winding apparatus of the final edge 11 in which the final edge 11 is wound on the log 12 outside of the layer of paper equipped with glue.

The winding apparatus of the final edge 11 on the log 12 comprises a pair of winding rollers 27, 28 arranged one roller on top of the other roller 27 to make a passage, of the calendered type, for the log 12.

Such a pair of winding rollers 27, 28, like for the unwinding rollers 13, 14, are independently motorised and can be selectively actuated to impose upon the log 12 a rolling without feeding between the rollers 27, 28 themselves, as well as, the expulsion of the finished log 12 from the machine 10.

Figure 5:
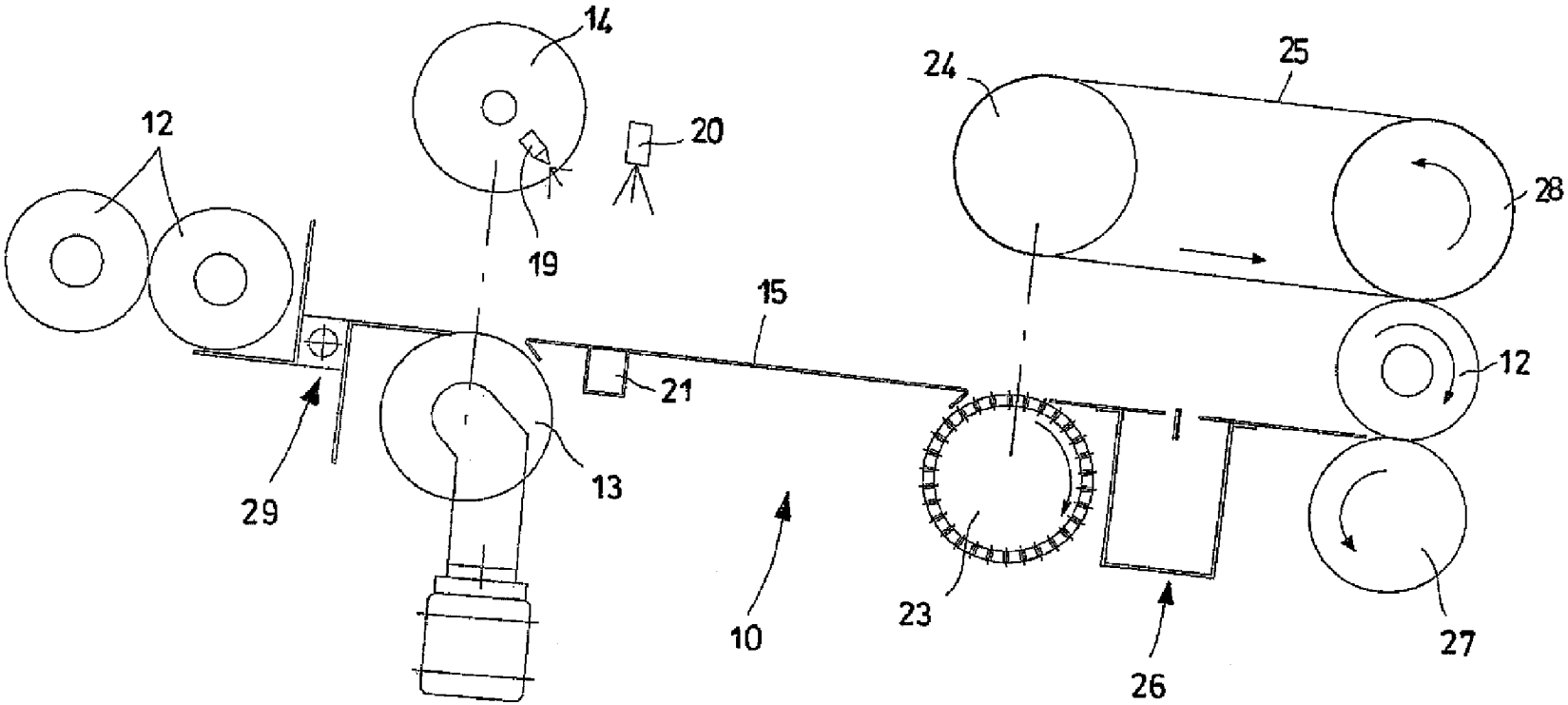

The rewinding step of the edge 11 is shown in FIG. 5.

Once such a step has ended, the roller 27 is blocked to take care of expelling the finished log 12.

From the above description, it is easy to understand how the gluing machine for the gluing of the final edge of a log according to the present invention operates.

The machine 10, in order to glue the final edge 11 of a log 12 onto the relative log, successively carries out the following operative steps of:

a) introducing the logs 12 equipped with a free edge 11 one after the other into the machine 10;

b) unwinding the log 12 and simultaneously identifying the final edge 11;

c) taking the final edge 11 away from the log 12;

d) transferring glue onto the log 12; and e) rewinding the final edge 11 onto the log 12 in which in all of the aforementioned steps it is possible to independently impose rotation speeds to the log 12, moving forward or rotating without feeding, that are mutually different and suitable for making the process as fast as possible without jeopardising the precision of the gluing.

In particular, the step of unwinding the log 12 takes place by making the log 12 roll without feeding between a pair of rollers 13, 14 arranged one 14 on top of the other 13 while the forward movement downstream of them 13, 14 is carried out through a free rolling of the log 12 on an inclined surface 15.

It has thus been seen that the gluing machine for the gluing of the final edge of a log according to the present invention achieves the purposes outlined earlier.

Indeed, the gluing machine for the gluing of the final edge of a log according to the present invention allows a finished log to be made very quickly and precisely in which both the feeding speeds of the log between the various work stations and the various rolling speeds without feeding imposed upon the log in the stations themselves are mutually independent and can be set differently according to requirements.

In other words, the machine according to the present invention allows the log to be given a high rotation speed when permitted and as slow as required in order to optimise the speed/production quality binomial of a finished log.

For example, in the machine according to the present invention there are no common elements between the unwinding station and the subsequent feeding section to the next station such as to in no way limit the feeding speed of the log downstream of the unwinding.

The gluing machine for the gluing of the final edge of a log of the present invention thus conceived can undergo numerous modifications and variants, all of which are covered by the same inventive concept; moreover, all of the details can be replaced by technically equivalent elements. In practice, the materials used, as well as their sizes, can be whatever according to the technical requirements.

The invention claimed is:

1. A gluing machine for a gluing a final edge of logs, which are introduced into said gluing machine one after another, said gluing machine comprising:

an identification means for identifying said final edge of said logs;

an unwinding apparatus, which is associated with said identification means for identifying said final edge of said logs;

an opening apparatus for opening and holding said final edge from said log;

at least one inclined surface for free rolling of said logs arranged downstream of said unwinding apparatus and upstream of said opening apparatus;

a glue transfer apparatus; and a rewinding apparatus, wherein said unwinding apparatus comprises a pair of rollers arranged one on top of the other and spaced apart from each other to create a passage for said logs, said pair of rollers are selective for feeding said logs and for retaining said logs in rotation, wherein only said at least one inclined surface for free rolling of said logs is arranged downstream from said pair of rollers of said unwinding apparatus and upstream of said opening apparatus, and wherein said at least one included surface is arranged upstream of said glue transfer apparatus.

2. The gluing machine of claim 1, wherein said pair rollers are each independently motorized.

3. The gluing machine of claim 1, further comprising a timing apparatus for said logs arranged between said pair of rollers and said opening apparatus.

4. The gluing machine of claim 3, wherein said gluing machine comprises a first inclined surface for free rolling of said logs, which starts downstream from said pair of rollers of said unwinding apparatus and ends upstream from said timing apparatus and a second inclined surface for free rolling of said logs, which starts downstream from said timing apparatus and ends upstream from said opening apparatus.

5. The gluing machine of claim 3, wherein said timing apparatus comprises a pair of rollers arranged one on top of the other to create a passage for said logs, said pair of rollers being selective for feeding and for retaining in rotation said logs.

6. The gluing machine of claim 1, wherein one of said rollers of said pair of rollers of said unwinding apparatus is an unwinding roller and said identification means of said final edge comprises a blowing element associated with said unwinding roller for unwinding said final edge on said at least one inclined surface, a detection photocell of said final edge laid on said at least one inclined surface and a suction box for maintenance of said final edge laid on said at least one inclined surface.

7. The gluing machine of claim 1, wherein said opening apparatus comprises a pair of rollers arranged one on top of the other to create a passage for said logs, said pair of rollers is selectively provided for feeding said logs and for retaining said logs in rotation, and at least one of said rollers is a suction roller to retain said final edge.

8. The Gluing machine of claim 7, wherein said rollers of said pair of rollers of said opening apparatus includes an upper roller and a suction roller located below the upper roller, and said opening apparatus further comprises an upper belt located downstream from said upper roller for cooperating with said suction roller to feed said logs to said glue transfer apparatus.

9. The gluing machine of claim 1, wherein said rewinding group of said final edge on said logs comprises a pair of rollers arranged one on top of the other to create a passage for said logs, and said pair of rollers are selectively provided for feeding said logs and for retaining said logs in rotation.

10. A gluing method for gluing of a final edge of logs, the method comprising the steps of:

a) introducing said logs into a machine one after another;

b) unwinding said logs and simultaneously identifying said final edge;

c) moving said final edge away from said logs;

d) transferring glue onto said logs; and e) rewinding said final edge on said logs wherein said steps impose mutually independent rotation speeds to said logs, and subsequently to said step of unwinding said logs there is provided the step of making said log roll freely on at least one inclined surface.

11. The gluing method of claim 10, wherein said step of unwinding said logs comprises a phase of rolling without feeding said log between a pair of rollers arranged one on top of the other.

12. The gluing method of claim 11, wherein said phase of rolling without feeding said logs between said rollers comprises the step of identifying an angle between said final edge and a vertical in function of a diameter of said logs and a length of said at least one inclined surface.

13. The gluing method of claim 10, further comprising the step of rolling without feeding said logs between a pair of rollers arranged one on top of the other downstream from a first inclined surface and upstream from a second inclined surface and identifying an angle between said final edge and a vertical in function of a diameter of said logs and a length of said second inclined surface.

* * * * *